United States Patent [19]

Hingst

[11] Patent Number: 4,819,451

[45] Date of Patent: Apr. 11, 1989

[54] CRYOSTATIC DEVICE FOR COOLING A DETECTOR

[76] Inventor: Uwe G. Hingst, Rebenstrasse 18, 7991 Oberteuringen, Fed. Rep. of Germany

[21] Appl. No.: 131,219

[22] Filed: Dec. 10, 1987

[30] Foreign Application Priority Data

Dec. 13, 1986 [DE] Fed. Rep. of Germany ..... 3642683

[51] Int. Cl.[4] ..... F25B 19/00

[52] U.S. Cl. ..... 62/514 JT; 62/3; 250/352

[58] Field of Search ..... 62/3, 514 JT; 250/352

[56] References Cited

U.S. PATENT DOCUMENTS

| | | | |
|---|---|---|---|
| 2,990,699 | 7/1961 | Dennis | 62/514 JT |
| 3,055,191 | 9/1962 | Dennis | 62/514 JT |
| 3,691,784 | 9/1972 | Nicholds et al. | 62/514 JT |
| 4,028,907 | 6/1977 | Herrington et al. | 62/514 JT |
| 4,537,033 | 8/1985 | Kamil | 62/3 |

FOREIGN PATENT DOCUMENTS

| | | |
|---|---|---|
| 1153374 | 9/1962 | United Kingdom . |
| 1238911 | 7/1971 | United Kingdom . |

OTHER PUBLICATIONS

*Kaltetechnik* 15. Jahrgang Heft 5/1963, by D. H. Juller, pp. 137–143.

*IPC Business Press Ltd.,* Engineering Outline 211, Miniature Cryogenic Refrigerators, by Dr. Ian Firth, pp. 93–96.

*Primary Examiner*—Ronald C. Capossela

*Attorney, Agent, or Firm*—Lee & Smith

[57] ABSTRACT

In a cryostatic device for cooling an infrared detector, based on the Joule-Thomson effect, a countercurrent heat exchanger is located with a forward flow conduit in a Dewar vessel. The forward flow conduit ends in an expansion nozzle. The infrared detector is located on the front side of the inner wall of the Dewar vessel. To reduce the heat load, a heat insulating layer is arranged between the Dewar vessel and a base. To improve the cooling power of the Joule-Thomson process achievable with a predetermined pressurized gas mass flow, an inlet end of the forward flow conduit is cooled by Peltier elements. Thus the required pressurized gas flow is reduced.

6 Claims, 4 Drawing Sheets

CRYOSTATIC DEVICE FOR COOLING A DETECTOR

The invention relates to a cryostatic device in which the Joule-Thomson effect is used, for cooling a detector, particularly for target seeking missiles.

For target seeking missiles, in many cases infrared detectors are used, which respond to the heat radiation from a target to be tracked. Such infrared detectors must be cooled very much in order to increase the sensitivity of the infrared detector and to improve the signal-to-noise ratio. To this end, cryostatic devices are known, in which the Joule-Thomson effect (Pohl "Einführung in die Mechanik, Akustik und Wärmelehre", Springer-Verlag, IX. edition, page 302) is used.

U.S. Pat. No. 2,990,699 describes a cryostatic device for cooling an infrared detector. The infrared detector is located on the inner wall on the "bottom" of a Dewar vessel. The Dewar vessel has an inner and an outer wall. The cooling is effected by means of a coutercurrent heat exchanger having a forward flow conduit connected with one inlet end to a pressurized gaz source. This forward flow conduit is arranged in a narrow coil inside the Dewar vessel. An expansion nozzle is provided at the oulet end of the forward flow conduit. In U.S. Pat. No. 2,990,699 this relaxiation nozzle is simply the free end of the forward flow conduit. The forward flow conduit is in well heat conducting contact with the return flow passage means. In U.S. Pat. No. 2,990,699 this return flow passage means is simply the inner space of the Dewar vessel. The expanded gas flows through this inner space to the opening of the Dewar vessel through the coiled forward flow conduit. Thereby the pressurized gas is precooled in the countercurrent method. According to this method detectors may be cooled down to temperatures of 80 K.

The cryostatic device requires a pressurized gas source. Therefore high-pressure bottles or also compressors have been provided.

Modern missiles are also highly heated during the carried flight, that is while they are still hanging on an aircraft because of the high speed of the aircraft. Also the missles comprise an extensive electronic system. This electronic system consumes electric energy, which is finally converted into heat. Thereby a seeker head in which the infrared detector is arranged, is heated further.

This is disadvantagous for the cryostatic device cooling the infrared detector in two respects: on one hand a higher temperature gradient between the infrared detector and its environment has to be maintained due to the high temperature of the seeker head, if the infrared detector is to maintain its prescribed low temperature. This is difficult because with this temperature gradient also the heat flow from the environment to the cryostatic device and infrared detector is increased. The proportion of this heat flow caused by radiation is increased with the fourth power of temperature. Another disadvantage is, however, that the enthalpy difference available for the physical process of the Joule-Thomson effect decreases with increasing temperature. With the pressurized gas supply out of high-pressure bottles the fact, furthermore, to be taken into account that the lower limit of the pressure required for the cooling process increases with temperature. With constant volume of the high-pressure bottle the available pressurized gas quantity thus decreases with increasing temperature.

With increasing temperature of the seeking head, generally the environment of the cryostatic device, the required cooling power thus increases. In a cryostatic device of the present type this causes a higher consumption of pressurized gas. The high-pressure bottles with pressurized gas must be enlarged as compared to cryostatic device arareaments conventional up to now, or the operational time possible without exchanging the high-pressure bottles is reduced.

It is the object of the invention to reduce considerably the cooling power required in a cryostatic device of the type mentioned in the beginning.

According to the invention this object is achieved with a cryostatic device of the type mentioned in the beginning, in that the inlet end of the forward flow conduit is cooled by additional cooling means. Preferably these additional cooling means are cooled by Peltier elements.

The pressurized gas mass flow through the forward flow conduit is very small. In the cryostatic devices used in practice, it is in the order of 0.015 g/sec. In order to decrease the temperature of such a pressurized gas mass flow by at most 35° C., a cooling power of 200 to 500 mW is sufficient. Such a coolant power can be provided by conventional Peltier elements. By this precooing the pressurized gas supplied to the cryostatic device is "decoupled" from the temperature of the environment. This results in an overproportionally better cooling power of the cryostatic device or a correspondigly reduced pressurized gas flow required for maintaining a certain temperature of the infrared detector. With the application in a missile this means smaller less volumes of the high-pressure bottles for the pressurized gas, thus less weight and volume and therewith better performance of the missile. The additional power need for the Peltier elements as well as the heat produced thereby are so small that they have no noticeable disadvantage.

A further "decoupling" of the cryostatic device and of the infrared detector from the temperature of the environment can be obtained by arranging a heat insulating layer between the inlet side of the Dewar vessel and the heat dissipating base.

By the above described mesures the pressurized gas consumption for the cooling can be reduced down to one half.

Embodiments of the invention will now be described in greater detail with reference to the accompanying drawings.

Figure 1:
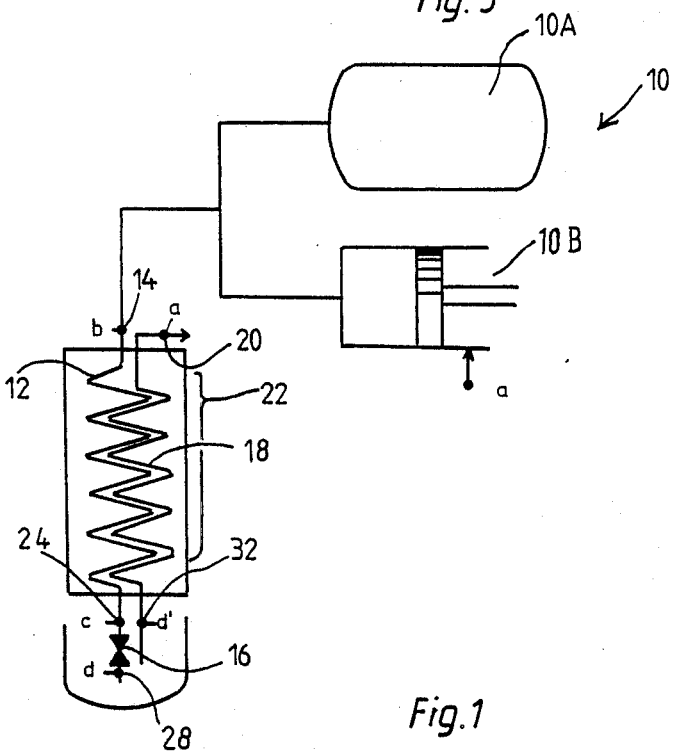
FIG. 1 is a schematic illustration of a cryostatic device using the Joule-Thomson effect.

In FIG. 1 a pressurized gas source, here a source of pressurized air, is designated by 10. The pressurized gas source may be a high-pressure bottle 10A or a compressor 10B. The pressurized gas is conducted through a forward flow conduit 12 from an inlet 14 of the forward flow conduit 12 to an expansion nozzle 16. The expanded gas is then conducted to an outlet 20 through a return flow passage means 18, which herein is also illustrated as conduit and which is in well heat conducting contact with the forward flow conduit 12. The forward flow conduit 12 and the return flow passage means 18 form a coutercurrent heat exchanger 22.

Pressurized gas flows from the inlet 14 through the forward flow conduit 12 to the expansion nozzle 16. There it cools down during the expansion because of the Joule-Thomson effect. The gas thus cooled down flows through the return flow passage means and causes precooling of the pressurized gas flowing in subsequently. This gas is then further cooled down during the expansion until finally very low temperatures are achieved.

Figure 2:
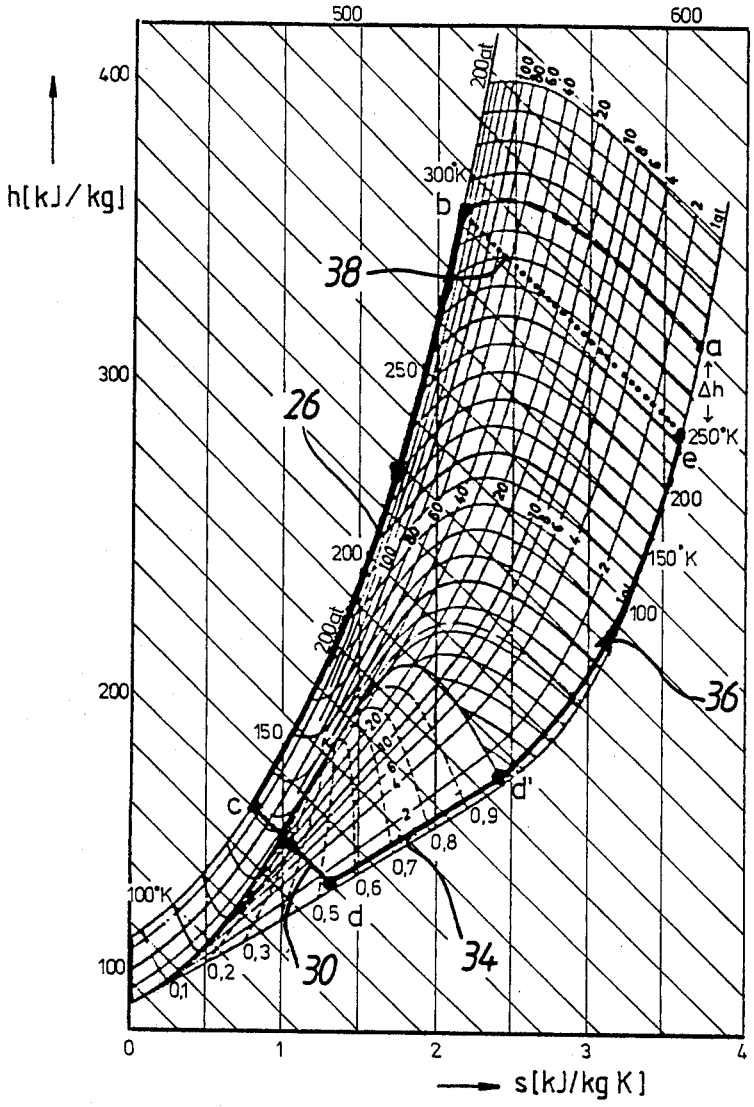
FIG. 2 is a schematic illustration of the Joule-Thomson process for air in an enthalpy-entropy-diagram.

The Joule-Thomson process will now be explained with reference to FIG. 2. FIG. 2 is an enthalpy/entropy diagram. The straight vertical lines of the grating are lines of constant entropy s in kJ/kg K . The lines extending diagonally from the upper left to the lower right of the grating are lines of constant enthalpy h in kJ/kg . In this grating, curves are plotted for the medium air, which curves correspond to different constant pressures from 200 bar to 1 bar. This is the group of curves which extends from the upper right to the lower left. A group of curves corresponding to different constant temperatures from 100 K to 300 k, extend crosswise to this group of curves, that is essentially from the upper left to the lower right.

At the inlet 14 of the cryostatic device, the pressurized air is in a state which corresponds to the point "b" in the diagram of FIG. 2, that is for example to a pressure of 200 bar at ambient temperature, that is approximately 300 K. The air flows then at essentially unchanged pressure of 200 bar through the prefolw conduction 12 to a point 24 in front of the expansion nozzle 16. Thereby, however, the air is cooled down by the expanded and cooled gas flowing in coutercourrent through the coutercurrent heat exchanger 22. The state of the pressurized gas in the forward flow conduit 12 thus moves on the way from inlet 14 to point 24 along the line 26 in the diagram of FIG. 2 to the point "c".

The pressurized gas is expanded in the expansion nozzle 16, the enthalpy remaining constant. On the spacial path from the point 24 in front of the expansion nozzle 16 to a point 28 behind the expansion nozzle 16, the state of the gas moves in the diagram of FIG. 2 along the line 30 from the point "c" to the point "d". The line 30 extend along a line of constant enthalpy. The point "c" is located on the 200 bar curve. The point "d" is located essentially on the 1 bar curve. The expansion takes place to nearly atmospheric pressure. Thereby heavy cooling down takes place. It can be seen that on the 1 bar curve the point "d" is located clearly below the point which corresponds to a temperature of 100° K.

The gas then absorbs heat from the object to be cooled, that is the infrared detector, and heats up to a temperature of approximately 100 K. at the inlet 32 of the return flow passage means 18. This takes place at contant pressure of essentially 1 bar. On the spacial way from point 28 to point 32, the state of the gas moves along the line 34 from point "d" to point "d'". The line 34 extends slightly above the 1 bar curve, as the pressure is slightly higher than atmospheric pressure.

The gas then flows through the return flow passage means 18 of the countercurrent heat exchanger 22 to the outlet 20. Therewith it absorbs heat from the pressurized gas entering the forward flow conduit and is heted up thereby from a temperature of approximately 100 K. to the ambient temperature of 300 K. The state of the gas moves in the diagram of FIG. 2 from a point "d'" along the line 36 to the point "a" in the intersection of the 300 K curve and the 1 bar curve. The point "a" in the diagram of FIG. 2 corresponds to an enthalpy per mass unit of $h_a$. If the dotted line 38 following a line of constant enthalpy, is followed from the point "b" to the line 36, that is practically the 1 bar curve, point "e" is met with which the enthalpy per mass unit $h_e$ (which is equal to the enthalpy of point "b") is associated. The cooling power of the cryostatic device, that is the heat quantity which at most can be removed from the infrared detector, is $$m \cdot (h_a - h_e),$$

if m is the mass of the pressurized gas passed through.

If thus the difference $\Delta h = h_a - h_e$ becomes smaller, the pressurized air mass flow must be increased, if the same cooling power, that is heat removal per unit time is to be achieved.

It can be seen from FIG. 2 that $\Delta h$ increases with increasing pressure (up to a maximum of 400 bar with air) in state "b". It can, however, also be seen, that $\Delta h$ decreases with increasing temperature in state "b".

Figure 3:
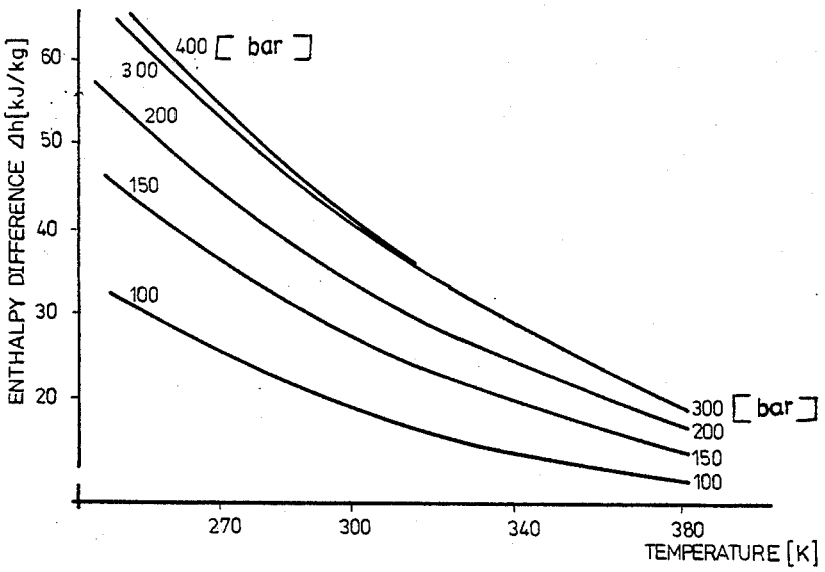
FIG. 3 is a diagram and shows the enthalpy difference occuring with the Joule-Thomson process according to FIG. 2 as a function of pressure and temperature at the inlet of the cryostatic device.

This is illustrated in FIG. 3. FIG. 3 shows the enthalpy difference per mass unit $\Delta h$ [kJ/kg] as a function of the temperature in [K] and of the inlet pressure in [bar], which exists at the inlet 14, thus of the position of the state point "b" of FIG. 2. It can be seen that an increase of the inlet temperature ($T_b$) causes a considerable reduction of the enthalpy difference and thus of the cooling power.

Thus the inlet temperature $T_b$ must be decreased in order to increase the cooling power per mass unit of the pressurized gas. Furthermore it is desirable to reduce the heat supply from the environment to the infrared detector and to the cryostatic device, that is the cooling power required for maintaining a certain temperature. Thereby the pressurized air mass flow required shall be reduced.

Figure 4:
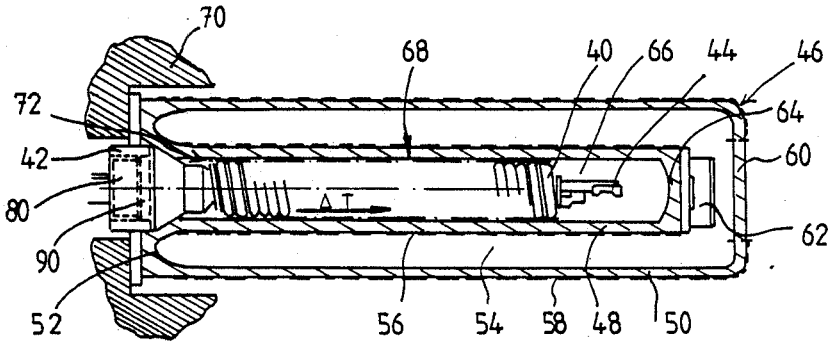
FIG. 4 is a schematic longitudinal sectional view of the cryostatic device with the Dewar vessel and the infrared detector.

The cryostatic device according to FIG. 4 comprises a forward flow conduit 40 in the form of a helix. The forward flow conduit 40 has an inlet end which is arranged in an inlet portion 42 in a way described hereinbelow and which is connected to a pressurized gas source. Air is conventionaly used as pressurized gas. The forward flow conduit 40 ends in an expansion nozzle 44. The forward flow conduit 40 is surrounded by a Dewar vessel 46.

The Dewar vessel 46 has a pot-shaped inner wall and an also pot-shaped outer wall 50 coaxial with the inner wall 48 and surrounding the inner wall 48 with an interspace therebetween. The inner wall 48 and the outer wall 50 are connected at their open ends by a head piece 52. Thereby a closed cavity is formed between the inner wall and the outer wall 48 and 50, respectively. The cavity 54 is evacuated. The cylindrical peripheral surfaces of the inner and outer wall 48 and 50, respectively, are provided with mirrors 56 and 58, respectively. The front surface 60 of the outer wall is not provided with mirrors and is transparent for the infrared radiation to be detected by the infrared detector.

The infrared detector 62 is located on the front surface 64 on the outer side of the inner wall 48, that is within the cavity 54. The infrared detector 62 may be exposed to the infrared radiation through the front surface 60 of the outer wall 50. The infrared detector 62 is cooled by the expanded and cooled gas emerging from the expansion nozzle 44.

The expanded and cooled gas flows out through the inner space 66 of the Dewar vessel 46 to its open end. This inner space 66 fulfills the function of the return flow passage means in a countercurrent heat exchange 68: The gas flows through the coiled forward flow conduit 40 and causes precooling of the inflowing pressurized gas.

The Dewar vessel 46 with the countercurrent heat exchanger 68, the expansion nozzle 44 and the detector 62 is held at its open end at a base 70. A heat insulating layer 72 is arranged between the base 70 and the Dewar vessel 46. Thereby the heat flows to the cryostatic device and to the infrared detector are reduced.

Figure 5:
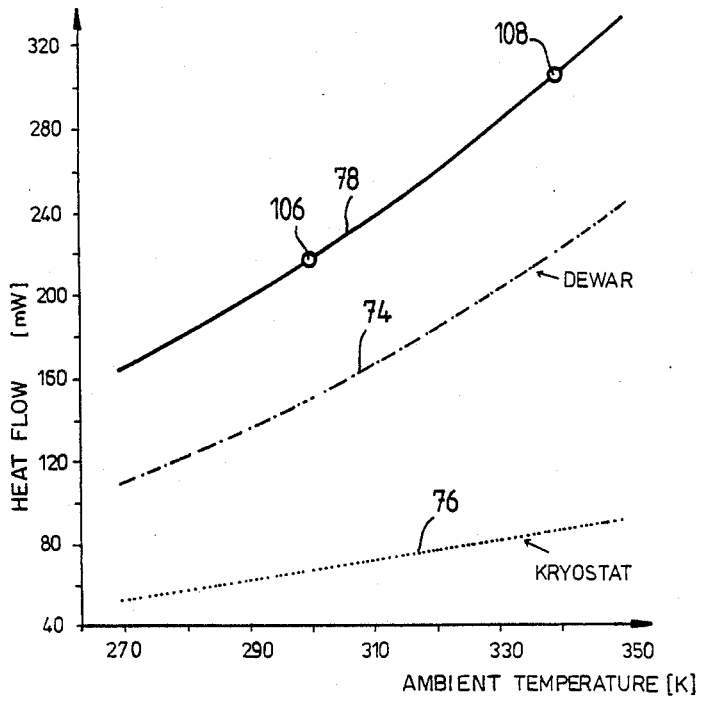
FIG. 5 illustrates the heat flows normally occuring in cryostatic devices.

The influence of these heat flows (without the insulating layer) can be seen from FIG. 5. This figure shows the heat flows in [mW] as a function of the ambient temperature, that is practically the temperature of the base 70. Curve 74 shows the heat flow transmitted through the Dewar vessel 46 to the infrared detector 62 cooled down to a regulated temperature of 80° K. Curve 76 shows the heat flow which flows through the real cryostatic device, that is essentially the forward flow conduit 40 to the expansion nozzle. The heat flows are transmitted from the walls 48 and 50 of the Dewar vessel 46 to the forward flow conduit 40 and the infrared detector not only by heat conduction but also, as indicated in FIG. 4, by heat radiation. Curve 78 shows the whole heat flow which must be removed by the cooling power of the cryostatic device.

It can be seen from FIG. 5 that the heat flows considerably increase with increasing ambient temperature. The largest part of the whole heat flow is transmitted through the Dewar vessel 46.

This part is considerably reduced by the heat insulating layer. The temperature drops from the temperature of the base 70 through the insulating layer 72 and along the Dewar vessel to the temperature of the infrared detector 62 of 80 K. Due to the high heat resistance of the heat insulating layer a large proportion of this temperature drop is effected across this layer. Accordingly the temperature of the Dewar vessel 46 is reduced in total. Thereby less heat is transmitted by radiation from the Dewar vessel 46 to the infrared detector 62 and the cryostatic device 68. For the heat conduction, the heat insulating layer acts, in electrotechnical analogy, as a "drop resistor" which at a predetermined "tension" reduces the "current".

Thus above all the proportion of the inflowing heat flow illustrated by curve 74 in FIG. 5 is reduced by the heat insulating layer 72.

Figure 6:
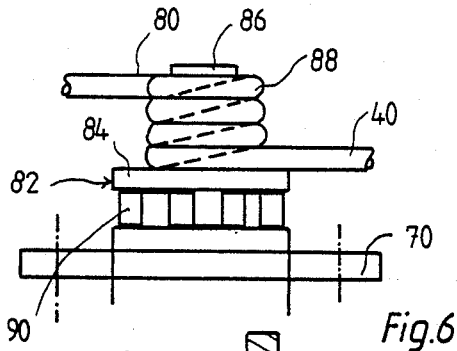
FIG. 6 shows schematically a first arareament for cooling the inlet end of the forward flow conduit in a cryostatic device according to FIG. 5.

In FIG. 6, the forward flow conduit is designated by 40, the inlet end 80 of this conduit being connected to the pressurized air source. The inlet end 80 of the forward flow conduit 40 is mounted on a carrier 82 of well heat conducting material and is in good heat conducting contact with this carrier 82. In the embodiment according to FIG. 6, the carrier 82 has a base plate 84 and a pin 86 projecting from the base plate 84. The inlet end 80 of the forward flow conduit 40 is wound as a coil 88 around the pin 86. The carrier 82 is mounted on the heat dissipating base or mounting base through Peltier elements 90. The cold sides of the Peltier elements 90 are in contact with the carrier 82.

In the embodiment according to FIG. 6, the base plate 84 is supported through the Peltier elements 90 on the base 70. The Peltier elements 90 are components which are commercially available as "Thermo-Chips" having the dimensions of 10 mm×10 mm×5 mm.

Figure 7:
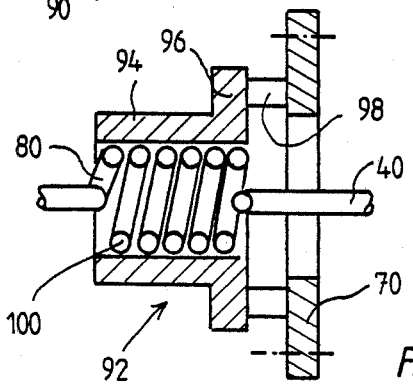
FIG. 7 shows schematically a second arareament for cooling the inlet end of the forward flow conduit in a cryostatic device according to FIG. 5.

In the embodiment according to FIG. 7, the carrier 92 is a sleeve 94 having a flange 96 at one end. The inlet end 80 of the forward flow conduit 40 is arranged in the sleeve 94 in contact with the inner wall thereof. The flange 96 is connected through Peltier elements 98 to the heat dissipating base 70.

In the embodiment according to FIG. 7, the inlet end 80 of the forward flow conduit 40 form a coil 100 inside the sleeve 94.

Figure 8:
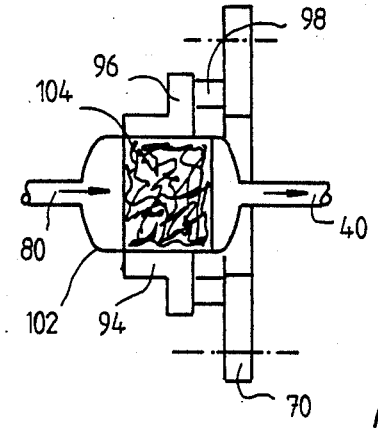
FIG. 8 shows schematically a modified third arareament for cooling the inlet end of the forward flow conduit in a cryostatic device according to FIG. 5.

In the embodiment according to FIG. 8, which for the rest is similarily constructed as the embodiment according to FIG. 7, the inlet end 80 of the forward flow conduit 40 forms a filter vessel 102 inside the sleeve 94. The filter vessel 102 contains a filter material 104, for example steel wool. The inlet end 80 of the forward flow conduit 40 is precooled by the Peltier elements 90 and 98, respectively. Thereby two things are achieved: On one hand, the temperature of the forward flow conduit at the inlet end 80 is reduced. This reduces the temperature gradient between the inlet end 80 and the expansion nozzle, such that the heat flow (corresponding to curve 76 of FIG. 5) flowing in through the forward flow conduit 40, or more generally the cryostatic device, is reduced. In so far the precooling through the Peltier elements 90 and 98, respectively, acts in the same sense as the heat insulating layer 72, namely in the sense of reducing the inflowing heat.

As has been explained hereinbefore in context with FIG. 2, the maximum cooling power available for a predetermined pressurized air mass flow depends on the enthalpy difference $\Delta h = h_a - h_e$ (FIG. 2). This enthalpy difference $\Delta h$ is largely increased if the inlet temperature $T_b$ of the pressurized gas is reduced. This can be seen from FIG. 3. The cooling of the inlet end 80 of the forward flow conduit 40 thus also and above all causes an increase of the cooling power achievable by the Joule-Thomson effect for a predetermined pressurized air mass flow. Thus a small pressurized air mass flow is sufficient in order to remove the heat flown to the cryostatic device and the infrared detector, and to maintain for example a temperature of the infrared detector of 80 K. If in modern missiles for the above mentioned reasons the environment assumes a higher temperature than this was the case in prior missiles, the cooling of the inlet end 80 of the forward flow conduit 40, at any rate, opposes an increase of the required pressurized air mass flow.

Quantitatively, the following can be deduced from the diagrams of FIG. 2, FIG. 3 and FIG. 5:

A temperature increase from 30° C. to 70° C., that is from approxiamately 300 K. to 340 K., what corresponds to the points 106 and 108, respectively, in the curve 78 of FIG. 5, without the described mesures would cause in the cryostatic device by aflowing heat a heat load by inflowing heat higher by the factor 1,4. Simultaniously, the enthalpy difference Δh, which determines, as explained, the cooling power, would also be reduced by a factor 1,4 at an inlet pressure of 200 bar.

The increased heat supply and the reduced cooling power per unit of the pressurized air mass flow results in a pressurized air mass flow increased by the factor 2 being required, in order to maintain the desired temperature of 80 K. at the infrared detector.

By insulating the Dewar vessel by means of the heat insulating layer, the heat load of the cryostatic device at 70° C. can certainly be reduced again by a factor ≧1,4. By the Peltier elements 90 and 98, respectively, a temperature decrease by approximately 35° C. at the inlet end 80 of the forward flow conduit can be achieved, as already mentioned above, with a power of 200 mW to 500 mW. This causes a further reduction of the heat load and an increase of the cooling power. Thus it is possible to operate with a pressurized air flow which is reduced by approximately the factor 2 as compared to a cryostatic device without the described mesures at the same ambient temperature. The temperature increase by 40° C. is thus absorbed and does not result in increased pressurized air consumption.

I claim:

1. Cryostatic device in which the Joule-Thomson effect is used, for cooling a detector, particularly for target seeking missiles, comprising (a) a pressurized gas source, (b) a countercurrent heat exchanger (68) having a forward flow conduit (40) connected with an inlet end (80) to the pressurized gas source, and return flow passage means in heat conducting contact therewith, (c) an expansion nozzle (44) provided at an outlet end of the forward flow conduit (40), the expanded pressurized gas flowing out through the return flow passage means, (d) a Dewar vessel (46) having an inner and an outer wall (48,50) and surrounding the heat exchanger (68) and the expansion nozzle (44), and carrying on its inner wall (48) in the area of the expansion nozzle (44), the detector (62) to be cooled, characterized in that (e) the inlet end (80) of the forward flow conduit (40) is cooled by additional cooling means formed by Peltier elements (90, 98), (f) the inlet end (80) of the forward flow conduit (40) is mounted on a carrier (82,92) of well heat conducting material in good heat conducting contact therewith, and (g) the carrier (82,92) is mounted through the Peltier elements (90,98) on a heat dissipating base, the cold side of the Peltier elements (90,92) being in contact with the carrier (82,92).

2. Cryostatic device as set forth in claim 1, characterized in that (a) the carrier (82) has a base plate (84) supported on the Peltier elements (90) and a pin (86) projecting from the base plate (84), and (b) the inlet end (80) of the forward flow conduit (40) is wound as a helix (88) around the pin (86).

3. Cryostatic device as set forth in claim 1, characterized in that (a) the carrier (92) is a sleeve (94) having a flange (96) at one end thereof, (b) the inlet end (80) of the forward flow conduit (40) is arranged in the sleeve (94) in contact with its inner wall, and (c) the flange (96) is connected through the Peltier elements (98) to the heat dissipating base (70).

4. Cryostatic device as set forth in claim 3, characterized in that the inlet end (80) of the forward flow conduit (40) forms a helix (100) inside the sleeve (94).

5. Cryostatic device as set forth in claim 3, characterized in that the inlet end (80) of the forward flow conduit (40) inside the sleeve (94) forms a filter vessel (102) containing a filter material (104).

6. Cryostatic device as set forth in claim 1, characterized in that a heat insulating layer (72) is arranged between the end on the inlet side of the Dewar vessel (46) and the heat dissipating base (70).

* * * * *